US008025037B2

(12) United States Patent
Hiramatsu

(10) Patent No.: US 8,025,037 B2
(45) Date of Patent: Sep. 27, 2011

(54) VALVE GEAR AND ROCKER ARM UNIT

(75) Inventor: Naoki Hiramatsu, Aichi-ken (JP)

(73) Assignee: Otics Corporation, Aichi (JP)

( * ) Notice: Subject to any disclaimer, the term of this patent is extended or adjusted under 35 U.S.C. 154(b) by 419 days.

(21) Appl. No.: 12/292,935

(22) Filed: Dec. 1, 2008

(65) Prior Publication Data

US 2009/0145388 A1 Jun. 11, 2009

(30) Foreign Application Priority Data

Dec. 7, 2007 (JP) ..... 2007-317181

(51) Int. Cl.
*F01L 1/18* (2006.01)

(52) U.S. Cl. ..... 123/90.39; 123/90.45; 29/888.2; 74/559

(58) Field of Classification Search ..... 123/90.39, 123/90.44, 90.45; 29/888.2; 74/559, 567, 74/569
See application file for complete search history.

(56) References Cited

U.S. PATENT DOCUMENTS 7,350,489 B2 * 4/2008 Engelhardt et al. ..... 123/90.39

FOREIGN PATENT DOCUMENTS

| | | |
|---|---|---|
| JP | 62-130104 | 8/1987 |
| JP | 62-169203 | 10/1987 |
| JP | 10-37719 | 2/1998 |
| JP | 2001-317310 | 11/2001 |
| JP | 2006-46325 | 2/2006 |

OTHER PUBLICATIONS

Japanese Office Action (Notification of Reasons for Refusal) dated Aug. 9, 2011 in corresponding Japanese Patent Application No. 2007-317181, together with English translation thereof.

* cited by examiner

*Primary Examiner* — Ching Chang
(74) *Attorney, Agent, or Firm* — Wenderoth, Lind & Ponack, L.L.P.

(57) ABSTRACT

A valve gear comprises a cylinder head, a supporting member fixed to the cylinder head, a rocker arm which is mounted on the supporting member so as to be placed on the latter, a substantially plate-shaped clip mountable to the rocker arm, the clip having a fitting hole in which an outer periphery of the supporting member is fitted so that the clip is prevented from falling off, a pair of walls which is formed on the rocker arm so as to be opposed to each other with the supporting member being located therebetween, and a pair of locking portions formed in inner faces of the walls so that outer edges of the clip are elastically engaged with the locking portions thereby to be locked, respectively.

16 Claims, 8 Drawing Sheets

VALVE GEAR AND ROCKER ARM UNIT

CROSS-REFERENCE TO RELATED APPLICATIONS

This application is based upon and claims the benefit of priority from the prior Japanese Patent Application No. 2007-317181 filed on Dec. 7, 2007, the entire contents of which are incorporated herein by reference.

BACKGROUND OF THE INVENTION

1. Field of the Invention

The present invention relates to a valve gear and a rocker arm unit.

2. Description of the Related Art

Internal combustion engines have conventionally been provided with a valve gear comprising a cylinder head, a supporting member fixed to the cylinder head, a rocker arm which is placed on the supporting member so as to be vertically rocked by a cam with the rocker arm serving as a fulcrum thereby to open and close a valve. Since the rocker arm is only placed on the supporting member, there is a possibility that the rocker arm may detach from the supporting member. Furthermore, when to be mounted on the cam and the valve, the rocker arm also tends to easily detach from the supporting member, whereupon the mounting work becomes troublesome.

In view of the aforenoted problem, Japanese patent application publication JP-A-2002-155710 discloses a clip holding the rocker arm so that the rocker arm is prevented from detaching from the supporting member. The clip is mounted to the rocker arm and caused to engage with the supporting member. However, the clip is mounted on the rocker arm so that the rocker arm is held between parts of the clip. The clip is bent for this purpose. Accordingly, the clip has a complicated shape, which increases the production cost of the clip.

BRIEF SUMMARY OF THE INVENTION

Therefore, an object of the present invention is to provide a valve gear and a rocker arm unit in each of which the shape of the clip can be simplified.

In one aspect, the present invention provides a valve gear comprising a cylinder head, a supporting member fixed to the cylinder head, a rocker arm which is mounted on the supporting member so as to be placed on the latter, a substantially plate-shaped clip mountable to the rocker arm, the clip having a fitting hole in which an outer periphery of the supporting member is fitted so that the clip is prevented from falling off, a pair of walls which is formed on the rocker arm so as to be opposed to each other with the supporting member being located therebetween, and a pair of locking portions formed in inner faces of the walls so that outer edges of the clip are elastically engaged with the locking portions thereby to be locked, respectively.

According to the above-described construction, the clip is mounted on the rocker arm so as to be held between the paired walls formed on the rocker arm. Hence, the clip is not mounted on the rocker arm so that the rocker arm is held between parts of the clip. Accordingly, the clip can be formed substantially into a flat plate shape since the clip need not be bent.

In another aspect, the invention provides a rocker arm unit comprising a cylinder head, a supporting member fixed to the cylinder head, a rocker arm which is mounted on the supporting member so as to be placed on the latter, a substantially plate-shaped clip mountable to the rocker arm, the clip having a fitting hole in which an outer periphery of the supporting member is fitted so that the clip is prevented from falling off, a pair of walls which is formed on the rocker arm so as to be opposed to each other with the supporting member being located therebetween, and a pair of locking portions formed in inner faces of the walls so that outer edges of the clip are elastically engaged with the locking portions thereby to be locked, respectively.

DETAILED DESCRIPTION OF THE EMBODIMENTS

Figure 1:
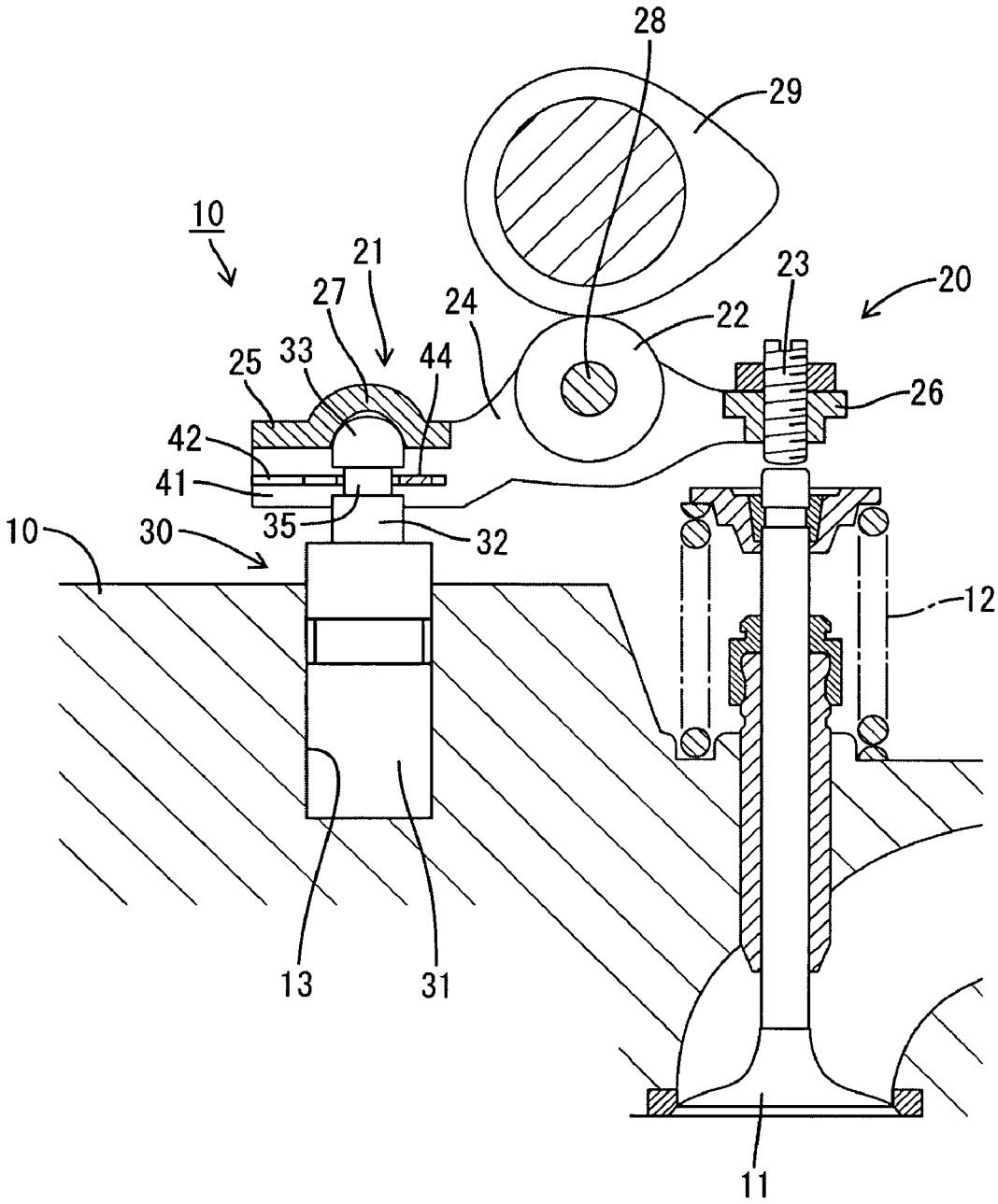
FIG. 1 is a partially broken schematic longitudinal section of a valve gear of a first embodiment in accordance with the present invention.
Figure 2:
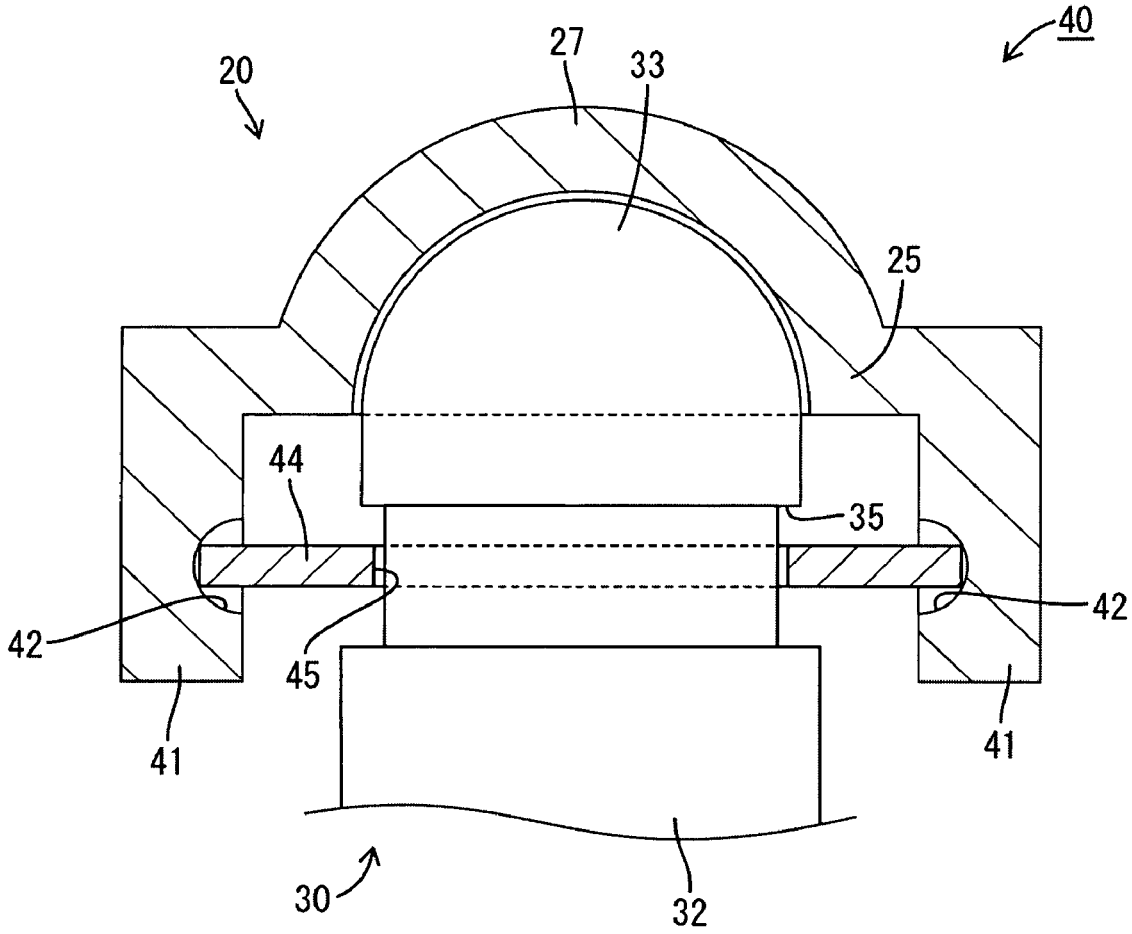
FIG. 2 is a transverse section of a rocker arm mounted on a lash adjuster by a clip.

A first embodiment of the present invention will be described with reference to FIGS. 1 to 5. The invention is applied to a valve gear of an internal combustion engine in the embodiment. The valve gear comprises a cylinder head 10 and a valve 11 which is mounted on the cylinder head 10 so as be vertically movable between a valve opening position and a valve closing position and so as to be biased by a valve spring 13 in a valve opening direction (upward). The valve 11 has an upper end protruding from an upper surface of the cylinder head 10.

A metal rocker arm 20 is provided over the cylinder head 10. The rocker 20 includes an arm body 21, a roller 22 mounted on the arm body 21 and an adjusting screw 23 mounted on the arm body 21. The arm body 21 includes a pair of arm portions 24 extending in the front-back direction, a fulcrum 25 connecting rear ends of both arms portions 24 to each other and a connecting portion 26 connecting front ends of the arms 24 to each other. The arm portions 24, the fulcrum 25 and the connecting portion 26 are formed integrally with one another. The fulcrum 25 is formed with a substantially semi-spherical (or dome-shaped) fitting portion 27 expanded upward. The adjust screw 23 having a vertical axis is screwed through the connecting portion 26. The roller 22 is located between arm portions 24 so as to assume a generally intermediate position between the fulcrum 25 and the connecting portion 26. The roller 22 is mounted on a support shaft 28 extending in the horizontal direction so as to be rotatable about the shaft. The roller 22 has an upper end which protrudes higher than the arms 24 and is abutted against an outer peripheral surface of a generally oval cam 29 mounted on a rotational shaft in parallel to the center of rotation of the roller 22.

A hydraulic lash adjuster 30 serving as a supporting member is mounted on a part of the cylinder head 10 located near to the valve 11. The lash adjuster 30 includes a bottomed cylindrical body 31 and a generally circular cylindrical plunger 32 which is enclosed in the body 31 so as to be movable vertically, as well known in the art. The body 31 is fixed so as to be buried in a mounting hole 13 opening in an upper surface of the cylinder head 10. The plunger 32 has an upper end which protrudes above the body 31 and is formed into a generally semi-spherical receiving portion 33. The rear end or the fitting portion 27 of the rocker arm 20 is fitted in the receiving portion 33 from above. On the other hand, the front end or the adjusting screw 23 of the rocker arm 20 is abutted against the upper end of the valve 11. Upon rotation of the cam 29, the rocker arm 20 is vertically swung with the receiving and fitting portions 33 and 27 serving as fulcrums. With swing of the rocker arm 20, the valve 11 is displaced in the valve opening direction or downward against the biasing force of the valve spring 12 and further displaced in the valve closing direction by the biasing force of the valve spring 12. The displacement in both valve opening and closing directions is repeated alternately.

Figure 3:
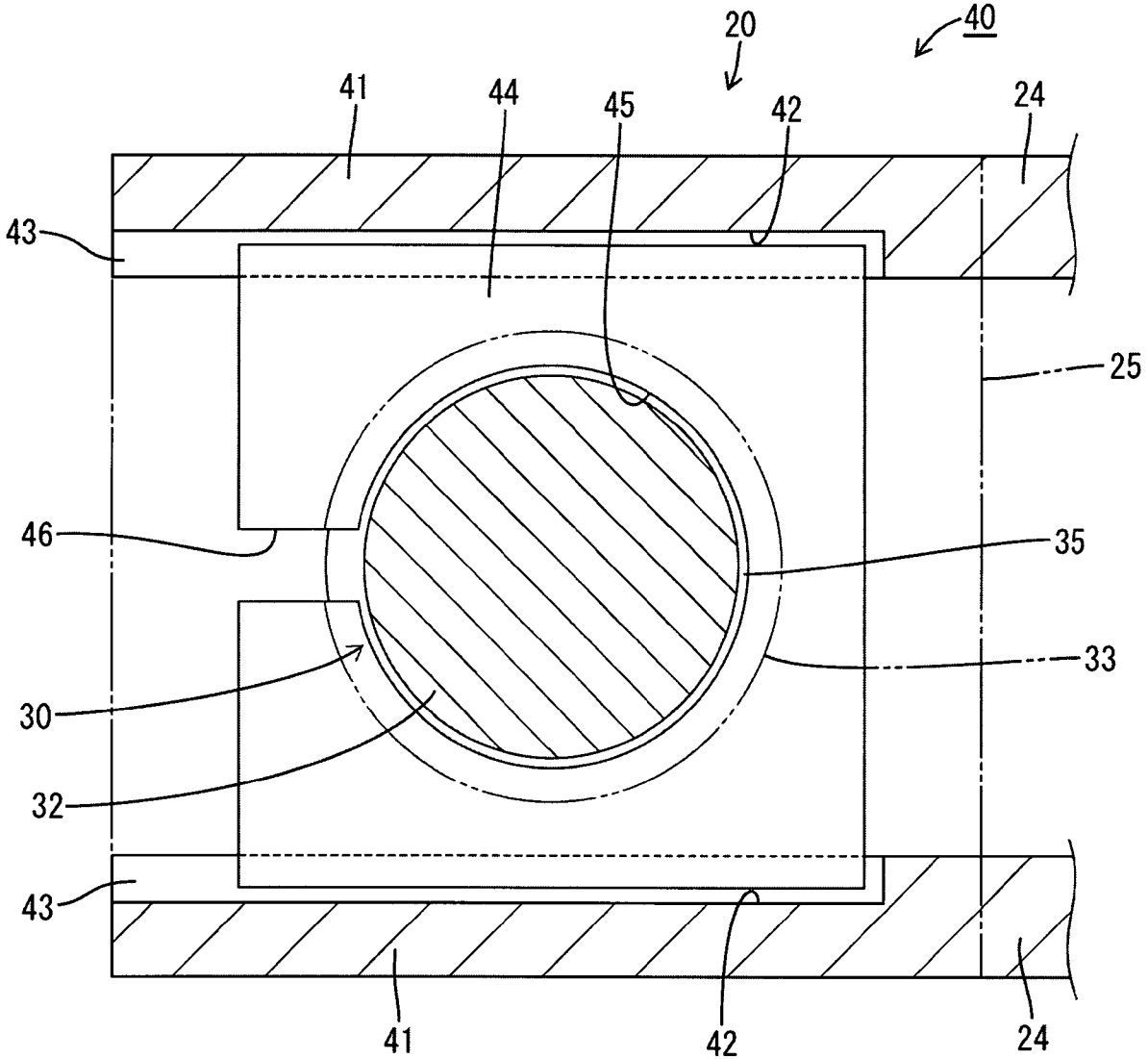
FIG. 3 is a horizontal sectional view of the rocker arm mounted on the lash adjuster by the clip.
Figure 4:
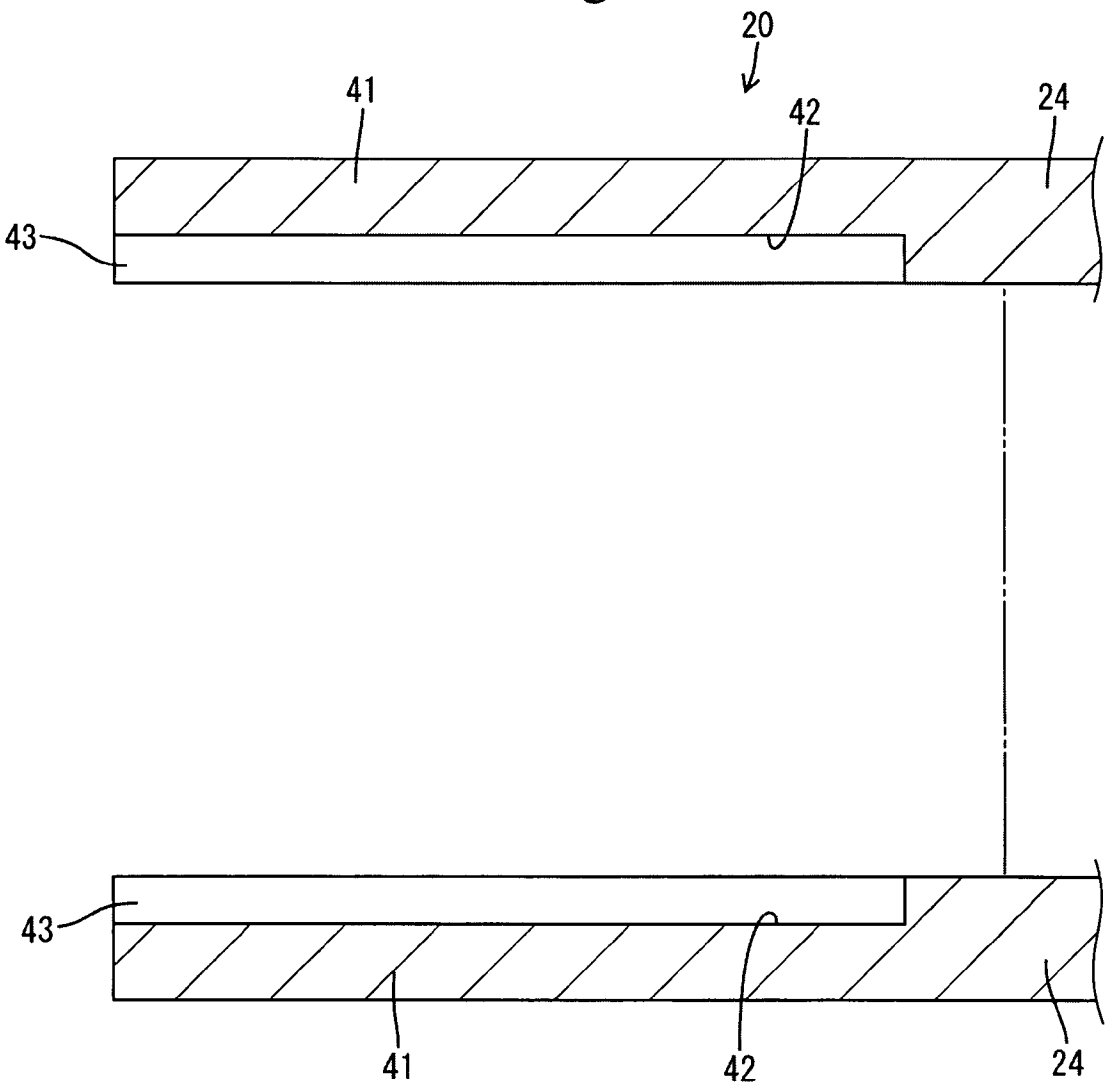
FIG. 4 is a horizontal sectional view of the rocker arm.
Figure 5:
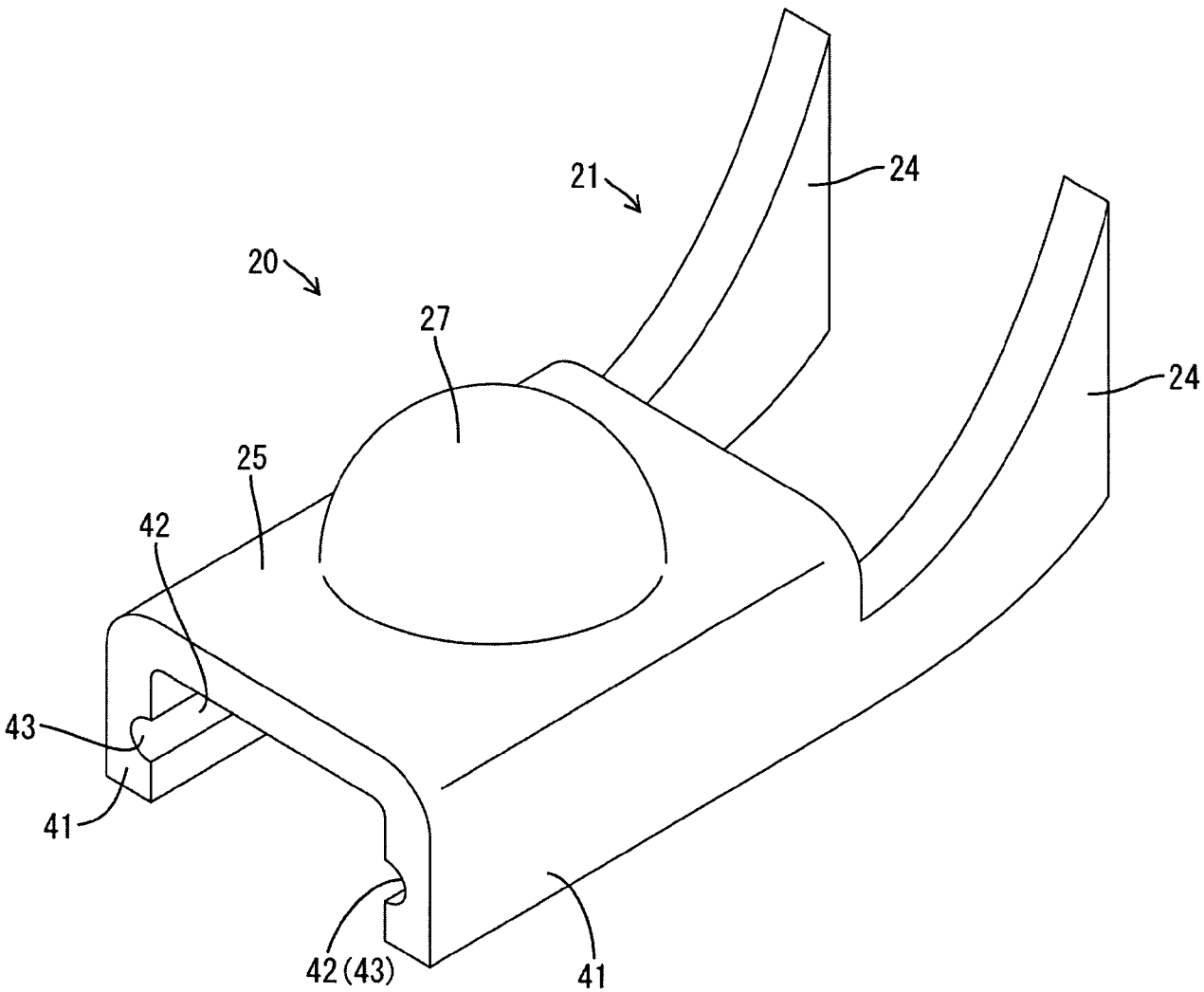
FIG. 5 is a partially enlarged perspective view of the rocker arm.

Now, the following describes the construction for holding the rocker arm 20 on the lash adjuster 39. The plunger 32 includes a part protruding (or exposing) higher than the body 31. The part of the plunger 32 has an outer periphery formed with a circular fitting groove 35 which is continuous along the entire periphery and concentric with plunger 32. A metal clip 44 is mounted on the rocker arm 20 and constitutes a rocker arm unit 40 together with the rocker arm 20. The paired arms 24 of the rocker arm 20 have rear ends including parts corresponding to the fulcrum 25 in the front-back direction respectively. These parts of the arms 24 serve as a pair of walls 41 confronting each other with the plunger 32 being interposed therebetween. The walls 41 have inner surfaces in which a pair of locking grooves 42 are formed by pressing or cutting so as to extend linearly in the front-back direction or in a direction perpendicular to the vertical direction in which the rocker arm 20 is mounted on the lash adjuster 30. The locking grooves 42 serve as locking portions in the invention. Each locking groove 42 has a generally semi-circular section perpendicular to the length direction. Furthermore, the locking grooves 42 have respective front ends which are located slightly at the back of a front end of the fulcrum 25 in the front-back direction. The locking grooves 42 further have open rear ends serving as assembly holes 43 which are open at rear end surfaces of the walls 41 (outer surface of the rocker arm 20), respectively, as shown in FIG. 3.

The clip 44 is formed into a generally square plate shape. The clip 44 has a circular fitting hole 45 which is formed substantially in a central part thereof so as to extend vertically therethrough. The fitting hole 45 has an inner diameter slightly larger than an outer diameter of the fitting groove 35 of the plunger 32 and slightly smaller than an outer diameter of the plunger 32. Furthermore, the clip 44 is formed with a notched groove 46 extending from a rear edge thereof to the fitting groove 45.

The following describes a mounting sequence of the rocker arms 20 and the lash adjuster 30. Firstly, the front ends of both side edges of the clip 44 are inserted into the assembly holes 43 of the locking grooves 42 from the rear respectively. Subsequently, the front ends of the clip 44 are further inserted into the locking grooves 42 respectively. The clip 44 is thus fitted between the walls 41 until the fitting grooves 42 are located concentrically with the fitting portion 27. In this case, the clip 44 is elastically flexed so that a width thereof (the width of the notched groove 46) is reduced. A resulting elastic recovering force causes both side edges of the clip 44 to be elastically abutted against the inner surfaces of the locking grooves 42. The elastic abutment of the clip 44 and the locking grooves 42 generates a frictional force, which force causes the clip 44 to be held at a predetermined position relative to the rocker arms 20. The mounting of the rocker arm unit is thus completed.

Subsequently, the rocker arm 20 is mounted onto the plunger 32. In this case, the upper end of the plunger 32 is abutted against the inner edge of the fitting hole 45, whereupon the clip 44 is elastically curved thereby to spread the fitting hole 45. When the spread fitting hole 45 passes the upper end of the plunger 32, the clip 44 returns to its flat-plate shape by the elastic returning force thereof. As a result, the plunger 32 is fitted in the fitting hole 45 while being allowed to be movable radially relative to the fitting groove 35. The rocker arm 20 is mounted on the plunger 32 by the locking of the fitting groove 35 and the fitting hole 45 while being prevented from upwardly falling off from the plunger 32. In this state, the fitting portion is mounted on the receiving portion 33 so as to be placed on the receiving portion 33. The rocker arm 20 is allowed to swing vertically relative to the plunger 32 with the receiving and fitting portions 33 and 27 serving as respective fulcrums.

In the foregoing embodiment, the plate-shaped clip 44 has the fitting hole 45 in which the plunger 32 is fitted so that the clip is prevented from falling off from the fitting hole 45, as described above. The clip 44 is fitted in the locking grooves 42 of the paired walls 41 of the rocker arm 20, whereby the clip 44 is held on the rocker arm 20 so as to be prevented from falling off from the fitting hole 45. Thus, the clip 44 is mounted so as to be held between the paired walls 41 formed on the rocker arm 20 but not so as to hold the rocker arm between two portions thereof. Consequently, the clip 44 need not be formed into a bent shape. Accordingly, the clip 44 can be rendered flat plate-shaped.

Furthermore, since the locking portion of the rocker arm 20 is formed by recessing a part of wall 41, the clip 44 need not be formed with a recess in the outer edge thereof, whereupon the shape of the outer edge of the clip 44 can be simplified. Additionally, the locking portion is substantially at right angles to the direction in which the rocker arm 20 is mounted on the lash adjuster 30, and the locking groove 42 is open in the outer surface (rear end surface) of the rocker arm 20 as the mounting hole 43. As a result, the clip 44 can be mounted by pushing the same through the mounting hole 43 into the locking groove 42.

Figure 6:
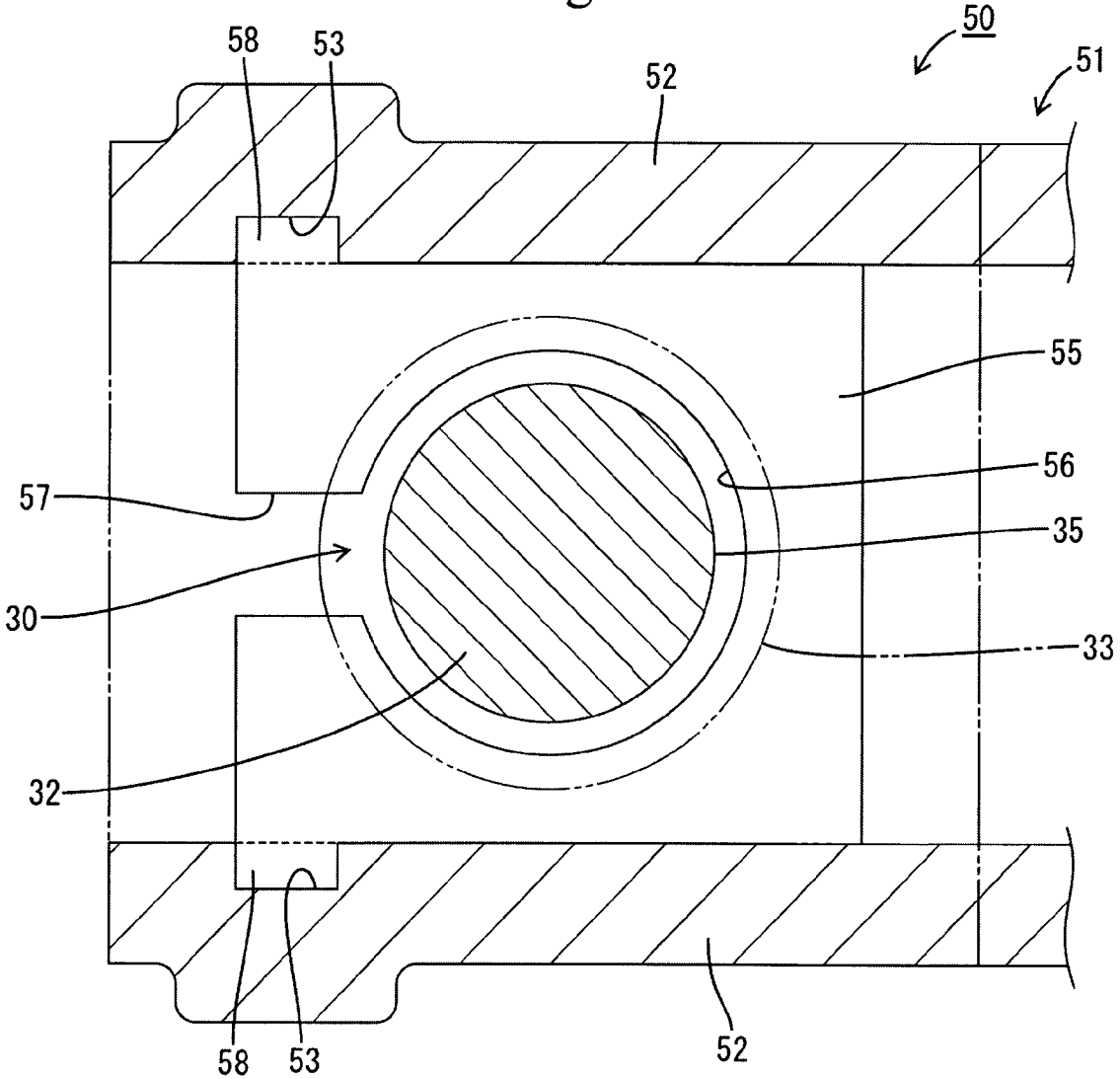
FIG. 6 is a horizontal sectional view of the rocker arm mounted on the lash adjuster by the clip in the valve gear of a second embodiment in accordance with the invention.

A second embodiment will be described with reference to FIG. 6. The second embodiment differs from the first embodiment in forms of the rocker arm 51 constituting the rocker arm unit 50 and the clip 55. The second embodiment is the same as the first embodiment in the other structure of the valve gear. Identical or similar parts in the second embodiment are labeled by the same reference numerals as in the first embodiment. A pair of recesses 53 are formed in the inner surfaces of paired walls 52 of the rocker arm 51 respectively, instead of the locking grooves 42. The recesses 53 are formed by pressing the respective walls 52 and are located in the rear ends of the walls 52 respectively. On the other hand, the clip 55 has a fitting hole 56 and a notched groove 57. A pair of locking strips 58 are formed on both side edges of the right end of the clip 55 respectively. Each locking strip 58 has a substantially square horizontal planar shape.

When mounted on the rocker arm 51, the clip 55 is inserted between the paired walls 52 while being elastically deformed so as to be curved. Subsequently, the paired locking strips 58 are fitted into the recesses 53 respectively while the clip 55 is returned to its former flat shape by the elastic returning force thereof. The clip 55 is then prevented from displacement relative to the walls 52 by the fitting of the locking strips 58 in the respective recesses 53. Furthermore, the right and left side edges of the clip 55 are elastically abutted against the respective walls 52. Accordingly, the clip 55 is prevented from being inclined vertically with the locking strip 58 serving as the fulcrum.

The plunger 32 is inserted through the locker arm 51 from above after the clip 55 has been mounted on the rocker arm 51. The clip 55 is curved in the process of the fitting, whereby the fitting hole 56 is spread thereby to allow the plunger 32 to pass therethrough. The mounting is completed when the inner circumferential edge of the fitting hole 56 has been fitted in the fitting groove 35. In the second embodiment, the recess 53 serving to lock the clip 55 with the walls 52 is formed by pressing parts of the respective walls 52 outward. Consequently, the manufacturing cost of the valve gear can be reduced as compared with the case where the groove is formed by cutting.

Figure 7:
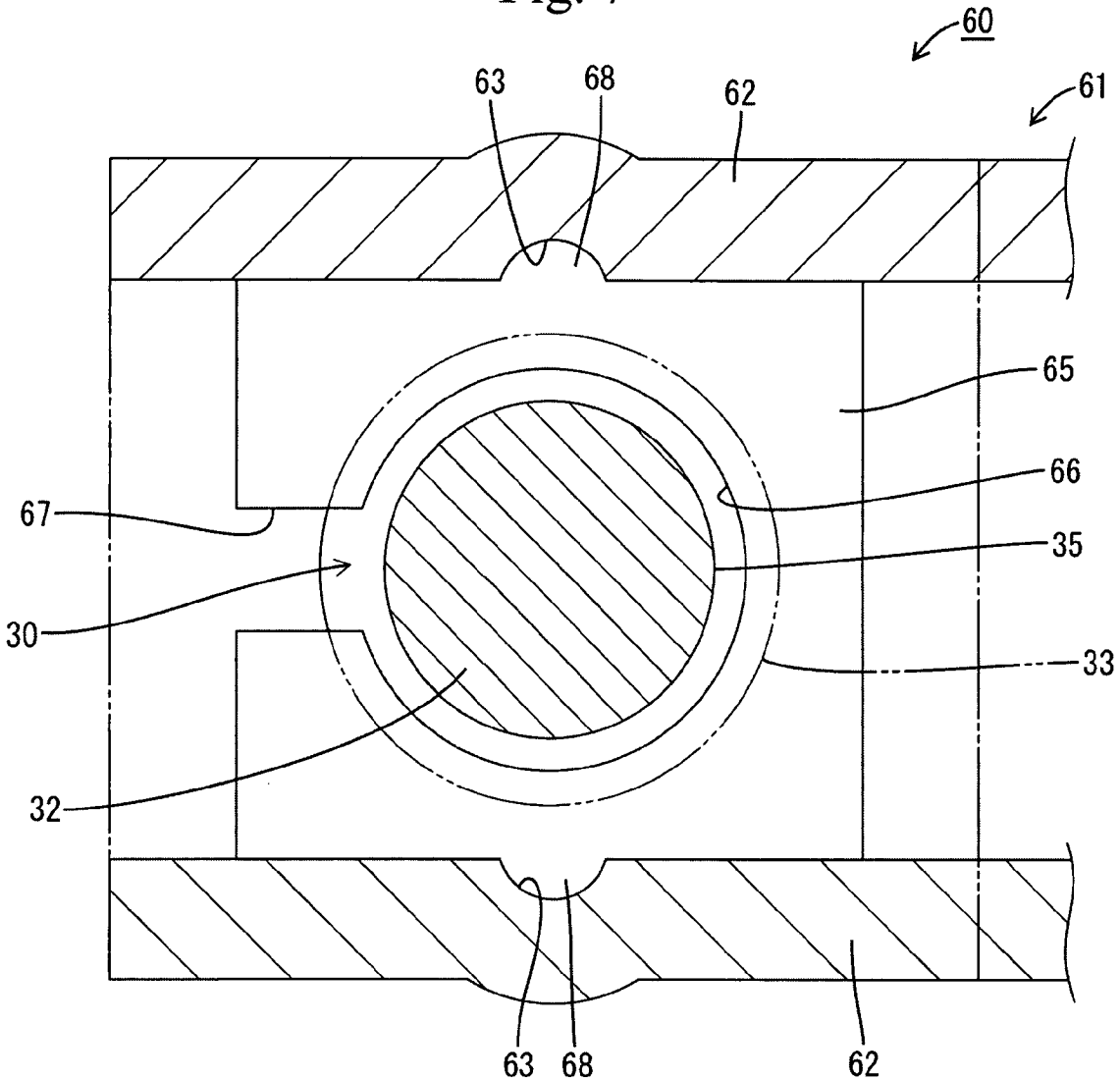
FIG. 7 is a horizontal sectional view of the rocker arm mounted on the lash adjuster by the clip in the valve gear of a third embodiment in accordance with the invention.

A third embodiment of the invention will now be described with reference to FIG. 7. The third embodiment differs from the first embodiment in forms of the rocker arm 61 constituting the rocker arm unit 60 and the clip 65. The third embodiment is the same as the first embodiment in the other structure of the valve gear. Identical or similar parts in the third embodiment are labeled by the same reference numerals as in the first embodiment.

A pair of recesses 63 are formed in the inner surfaces of paired walls 62 of the rocker arm 61 respectively, instead of the locking grooves 42. The recesses 63 are formed by pressing the respective walls 62 and are located in the middle of the walls 62 in the front-rear direction respectively. On the other hand, the clip 65 has a fitting hole 66 and a notched groove 67. A pair of locking strips 68 are formed on both side edges of the right end of the clip 65 respectively. Each locking strip 68 is located in the middle of the clip 65 has a substantially arcuate horizontal planar shape.

When mounted on the rocker arm 61, the clip 65 is inserted between the paired walls 62 while being elastically deformed so as to be curved. Subsequently, the paired locking strips 68 are fitted into the recesses 63 respectively while the clip 65 is returned to its former flat shape by the elastic returning force thereof. The clip 65 is then prevented from displacement relative to the walls 62 by the fitting of the locking strips 68 in the respective recesses 63. Furthermore, the right and left side edges of the clip 65 are elastically abutted against the respective walls 62. Accordingly, the clip 65 is prevented from being inclined vertically with the locking strip 68 serving as the fulcrum.

The plunger 32 is inserted through the locker arm 61 from above after the clip 65 has been mounted on the rocker arm 61. The clip 65 is curved in the process of the fitting, whereby the fitting hole 66 is spread thereby to allow the plunger 32 to pass therethrough. The mounting is completed when the inner circumferential edge of the fitting hole 66 has been fitted in the fitting groove 35. In the second embodiment, the recess 63 serving to lock the clip 65 with the walls 62 is formed by pressing parts of the respective walls 62 outward. Consequently, the manufacturing cost of the valve gear can be reduced as compared with the case where the groove is formed by cutting.

Figure 8:
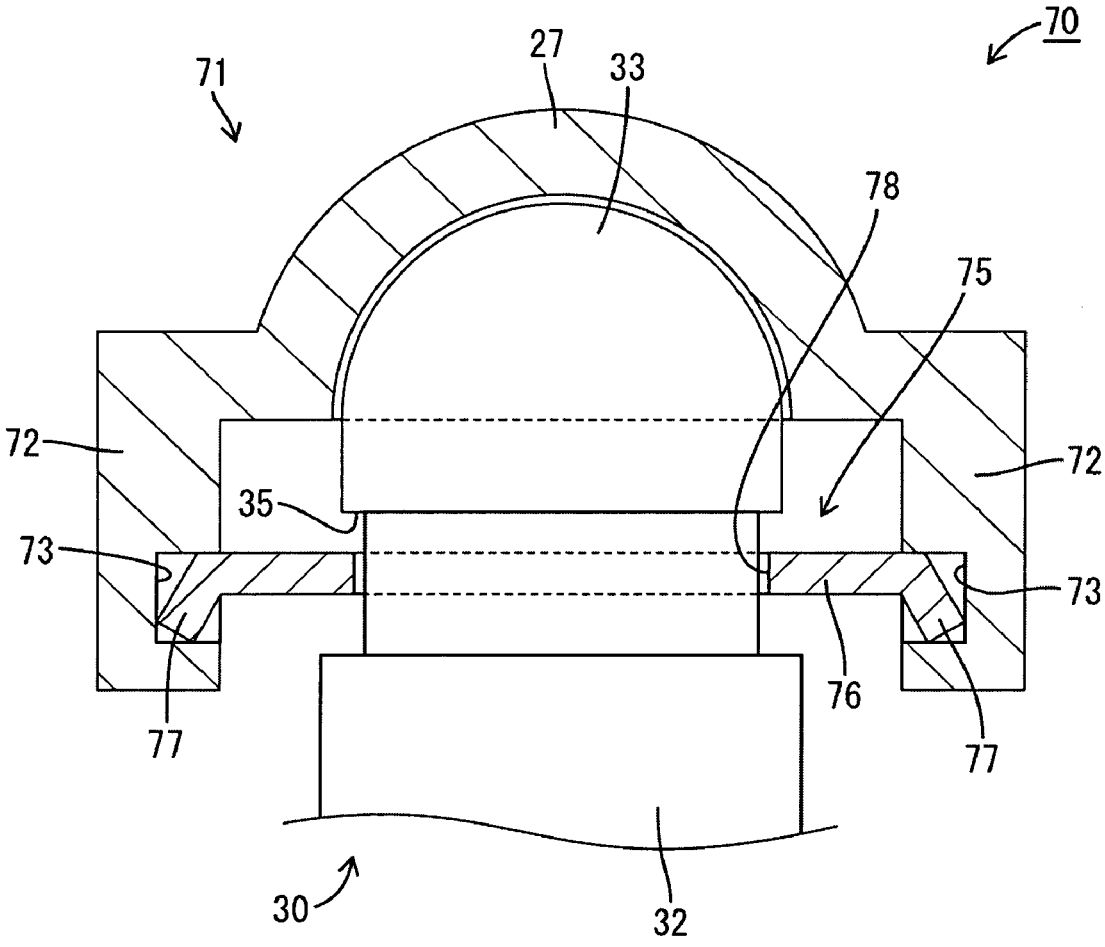
FIG. 8 is a transverse section of the rocker arm mounted on the lash adjuster by the clip in the valve gear of a fourth embodiment in accordance with the invention.

A fourth embodiment of the invention will now be described with reference to FIG. 8. The fourth embodiment differs from the first embodiment in forms of the rocker arm 71 constituting the rocker arm unit 70 and the clip 75. The fourth embodiment is the same as the first embodiment in the other structure of the valve gear. Identical or similar parts in the fourth embodiment are labeled by the same reference numerals as in the first embodiment.

A pair of locking grooves 73 are formed in the inner surfaces of the paired walls 72 of the rocker arm 71 respectively in the same manner as in the first embodiment. The locking grooves 73 extend forward from the rear ends of the walls 72 respectively. Each locking groove 73 has a square section perpendicular to the lengthwise direction thereof. On the other hand, the clip 75 has a square plate-shaped body 76 and a pair of elastic locking strips 77 extending obliquely downward from the right and left side edges of the body 76 in a cantilevered state. The body 76 and the locking strips 77 are formed integrally with each other. The body 76 has the fitting hole 78 formed in the same manner as in the first embodiment and a notched groove which is not shown and corresponds to the locking portion. Each locking strip 77 is formed so as to be continuous entirely from the front end to the rear end of the body 76 and so as to be elastically deformable.

When the clip 75 is mounted on the rocker arm 71, the elastic locking strips 77 are inserted into the respective locking grooves 73 from behind. In this case, the elastic locking strips 77 are elastically deformed slightly inward. Subsequently, the locking strips 77 are fitted into the locking grooves 73 respectively. When the fitting hole 78 has reached a position where the fitting hole 78 is in engagement with the fitting portion 27, the assembling of the clip 75 is completed. The elastic locking strips 77 are fitted in the locking grooves 43 respective in the assembled state of the clip 75. Accordingly, the clip 75 is prevented from being vertically swung. Furthermore, since the upper and lower edges of the elastic locking strips 77 elastically bite into the inner surfaces of the locking grooves 73 respectively, the clip 75 can be prevented from separating from the locking grooves 73.

The rocker arm 71 is fitted with the plunger 32 after the clip 75 has been mounted on the rocker arm 71. The clip 75 is curved during the fitting, whereby the fitting hole 78 is spread thereby to allow the plunger 32 to pass therethrough. The assembling is completed when the fitting hole 78 is fitted in the fitting groove 35. In the fourth embodiment, the clip 75 includes a flat plate-shaped body 76 extending substantially perpendicularly to the direction in which the rocker arm 71 is mounted on the lash adjuster 30 and the elastic locking strips 77 which extend from outer edges of the body 76 so as to be curved. The elastic locking strips 77 are elastically deformed when the clip 75 is to be mounted between the walls 72. As a result, the clip 75 can easily be fitted between the walls 72. The drive valve of the fourth embodiment is thus superior in the working efficiency in the assembly of the clip 75.

The locking portion should not be limited to the locking groove or the recess but may be a protrusion. When the locking portion is the protrusion, a recess or hole is formed in the outer edge of the clip so that the protrusion is held between portions of the recess or hole.

In the foregoing first embodiment, the locking groove should not be limited to the linear shape but may slightly be curved. Also in the first embodiment, the locking groove may be shaped so as not to be open in the outer surface of each wall. Furthermore, in the second and third embodiments, each recess 53 may be a through hole open in the outer surface of each wall. Also in the second and third embodiments, guide grooves may be formed so as to extend from the outer surface of the rocker arm to the recesses respectively. Furthermore, the supporting member should not be limited to the lash adjuster with variable height but may be a pivot with a fixed height.

In the second embodiment, the planar shape of the locking strip should not be limited to the square shape but may be arcuate, triangular or trapezoidal. In the third embodiment, the planar shape of the locking strip should not be limited to the arcuate shape but may be square, triangular or trapezoidal. In the fourth embodiment, the elastic locking strips may be formed at a plurality of positions spaced away from each other in the front-rear direction. Also in the fourth embodiment, the dimension of each elastic locking strip need not be the same as the entire length of body but may be shorter than the body. In this case, the elastic locking strip may be disposed at any position, for example, at the front end, the rear end or the longitudinally middle.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A valve gear comprising:

a cylinder head;

a supporting member fixed to the cylinder head;

a rocker arm which is mounted on the supporting member so as to be placed on the said support member;

a substantially plate-shaped clip mountable to the rocker arm, the clip having a fitting hole in which an outer periphery of the supporting member is fitted so that the clip is prevented from falling off;

a pair of walls which is formed on the rocker arm so as to be opposed to each other with the supporting member being located therebetween; and a pair of locking portions formed in inner faces of the walls so that outer edges of the clip are elastically engaged with the locking portions thereby to be locked, respectively.

2. The valve gear according to claim 1, wherein the locking portions are formed by recessing parts of the walls respectively.

3. The valve gear according to claim 2, wherein the locking portions are substantially at right angles to a direction in which the rocker arm is mounted on the supporting member, and the locking portions are locking grooves open in an outer surface of the rocker arm as an assembling hole.

4. The valve gear according to claim 3, wherein the clip includes a flat plate-shaped body which is substantially at right angles to a direction in which the rocker arm is mounted on the supporting member and a pair of elastic locking strip which extends from outer edges of the body so as to be bent and are locked by the locking portions respectively.

5. The valve gear according to claim 2, wherein the locking portions are recesses formed by pressing parts of the walls outwards respectively.

6. The valve gear according to claim 5, wherein the clip includes a flat plate-shaped body which is substantially at right angles to a direction in which the rocker arm is mounted on the supporting member and a pair of elastic locking strip which extends from outer edges of the body so as to be bent and are locked by the locking portions respectively.

7. The valve gear according to claim 2, wherein the clip includes a flat plate-shaped body which is substantially at right angles to a direction in which the rocker arm is mounted on the supporting member and a pair of elastic locking strip which extends from outer edges of the body so as to be bent and are locked by the locking portions respectively.

8. The valve gear according to claim 1, wherein the clip includes a flat plate-shaped body which is substantially at right angles to a direction in which the rocker arm is mounted on the supporting member and a pair of elastic locking strip which extends from outer edges of the body so as to be bent and are locked by the locking portions respectively.

9. A rocker arm unit comprising:

a cylinder head;

a supporting member fixed to the cylinder head;

a rocker arm which is mounted on the supporting member so as to be placed on the said support member;

a substantially plate-shaped clip mountable to the rocker arm, the clip having a fitting hole in which an outer periphery of the supporting member is fitted so that the clip is prevented from falling off;

a pair of walls which is formed on the rocker arm so as to be opposed to each other with the supporting member being located therebetween; and a pair of locking portions formed in inner faces of the walls so that outer edges of the clip are elastically engaged with the locking portions thereby to be locked, respectively.

10. The rocker arm unit according to claim 9, wherein the locking portions are formed by recessing parts of the walls respectively.

11. The rocker arm unit according to claim 10, wherein the locking portions are substantially at right angles to a direction in which the rocker arm is mounted on the supporting member, and the locking portions are locking grooves open in an outer surface of the rocker arm as an assembling hole.

12. The rocker arm unit according to claim 11, wherein the clip includes a flat plate-shaped body which is substantially at right angles to a direction in which the rocker arm is mounted on the supporting member and a pair of elastic locking strip which extends from outer edges of the body so as to be bent and are locked by the locking portions respectively.

13. The rocker arm unit according to claim 10, wherein the locking portions are recesses formed by pressing parts of the walls outwards respectively.

14. The rocker arm unit according to claim 13, wherein the clip includes a flat plate-shaped body which is substantially at right angles to a direction in which the rocker arm is mounted on the supporting member and a pair of elastic locking strip which extends from outer edges of the body so as to be bent and are locked by the locking portions respectively.

15. The rocker arm unit according to claim 10, wherein the clip includes a flat plate-shaped body which is substantially at right angles to a direction in which the rocker arm is mounted on the supporting member and a pair of elastic locking strip which extends from outer edges of the body so as to be bent and are locked by the locking portions respectively.

16. The rocker arm unit according to claim 9, wherein the clip includes a flat plate-shaped body which is substantially at right angles to a direction in which the rocker arm is mounted on the supporting member and a pair of elastic locking strip which extends from outer edges of the body so as to be bent and are locked by the locking portions respectively.

* * * * *